US008136340B2

(12) United States Patent
Hart

(10) Patent No.: US 8,136,340 B2
(45) Date of Patent: Mar. 20, 2012

(54) LATERAL FLOW HIGH VOLTAGE PROPELLANT ISOLATOR

(75) Inventor: Stephen L. Hart, Torrance, CA (US)

(73) Assignee: L-3 Communications Electron Technologies, Inc., Torrance, GA (US)

( * ) Notice: Subject to any disclaimer, the term of this patent is extended or adjusted under 35 U.S.C. 154(b) by 0 days.

(21) Appl. No.: 12/851,382

(22) Filed: Aug. 5, 2010

(65) Prior Publication Data

US 2010/0313543 A1 Dec. 16, 2010

Related U.S. Application Data

(62) Division of application No. 10/894,142, filed on Jul. 19, 2004, now Pat. No. 7,836,679.

(51) Int. Cl.
*F03H 1/00* (2006.01)

(52) U.S. Cl. ..... 60/202; 137/138

(58) Field of Classification Search ..... 60/200.1, 60/202, 203.1, 269
See application file for complete search history.

(56) References Cited

U.S. PATENT DOCUMENTS

| | | | | |
|---|---|---|---|---|
| 3,554,088 | A | | 1/1971 | Bruyn |
| 3,576,107 | A | * | 4/1971 | Nakanishi ..... 60/202 |
| 4,244,526 | A | * | 1/1981 | Arth ..... 239/533.1 |
| 4,838,021 | A | | 6/1989 | Beattie |
| 5,327,941 | A | * | 7/1994 | Bitsakis et al. ..... 138/42 |
| 5,924,277 | A | | 7/1999 | Beattie et al. |
| 5,934,965 | A | | 8/1999 | Beattie |
| 5,947,421 | A | | 9/1999 | Beattie et al. |
| 6,181,585 | B1 | | 1/2001 | Cardwell, Jr. et al. |
| 6,250,070 | B1 | | 6/2001 | Kreiner et al. |
| 6,318,069 | B1 | | 11/2001 | Falce et al. |
| 6,336,318 | B1 | | 1/2002 | Falce et al. |
| 6,619,028 | B2 | | 9/2003 | Kreiner et al. |
| 6,786,035 | B2 | | 9/2004 | Stickelmaier |
| 6,964,396 | B2 | | 11/2005 | Williams et al. |
| 2006/0075739 | A1 | | 4/2006 | Wiseman |

* cited by examiner

*Primary Examiner* — Ehud Gartenberg
*Assistant Examiner* — Vikansha Dwivedi
(74) *Attorney, Agent, or Firm* — Proskauer Rose LLP

(57) ABSTRACT

A high voltage propellant isolator includes at least two different types of isolator rings or segments, in alternating lateral arrangement, that direct the flow of propellant, such as xenon gas, in a tortuous path through the isolator.

10 Claims, 3 Drawing Sheets

LATERAL FLOW HIGH VOLTAGE PROPELLANT ISOLATOR

RELATED APPLICATIONS

This application is a divisional application of U.S. Ser. No. 10/894,142 filed on Jul. 19, 2004, the entire contents of which are incorporated herein by reference.

BACKGROUND

1. Field of the Invention

The present invention relates generally to isolators, and in particular, to high voltage ion propellant isolators.

2. Related Art

High power ion propulsion systems or thrusters produce thrust by accelerating a beam of positive ions through an electrostatic field to high velocities, positive ions are produced by electron bombardment of neutral propellant atoms in a discharge chamber. The discharge chamber is typically a cylindrical anode, with a centrally located axial hollow cathode. Typically, the cathode is heated to enable thermionic emission of electrons. Once cathode emission is established, a low current, low voltage discharge between the cathode and anode accelerates electrons into the discharge chamber. A magnetic field is applied to the discharge chamber which increases the electron path length and residence time in the chamber, and thus collision probability.

Propellant atoms (typically noble gases, such as Xenon) are injected into the chamber and collide with energetic electrons. These collisions remove additional electrons from the atoms, resulting in positive ions. A series of two or three perforated electrodes (called grids) attract the positive ions, accelerate them, and focus them into an ion beam. Finally, a neutralizer emits exactly the same number of electrons into the beam as there are ions, which prevents a large negative potential from building up.

Ion engine propellants are chosen for a combination of low ionization potential, high atomic weight, handling, and storage properties. However, lighter noble gases, such as krypton and argon, result in poor discharge chamber performance, increased erosion rates, and increased power required for a given thrust. Using xenon, on the other hand, allows major simplifications in the design of the thruster, its power processing unit, and its propellant feed system, but at a higher cost. Thus, krypton and argon are lower-cost alternatives, but result in lower performance and engine life relative to xenon.

Currently, xenon ion thrusters are desirable for use in spacecraft, such as satellites. One reason is the electrostatic acceleration process in ion propulsion is almost 100% efficient. In practice, the acceleration efficiency is typically 99.7%. This nearly lossless acceleration mechanism enables the development of ion engines which can process megawatts of input power while maintaining reasonable engine component temperatures without active cooling. Xenon ion thrusters are also capable of processing input powers from tens of kilowatts on up at impulses of thousands of seconds.

As the gas moves between ground and a high potential, ionization occurs, which can lead to uncontrolled current conduction through the gas, current flow is minimized by providing an electrical isolator between the two widely different potentials, such as between the gas source and the ion source. The current generation of isolator used for xenon delivery systems is based on utilizing segmented isolation, in which each segment consists of a metal screen separated with a ceramic washer. Isolators for current xenon thrusters utilize a stack of these segments, e.g., 8 to 13, to achieve the necessary voltage standoff. FIG. 1 shows a typical propellant isolator 100 for use in ion thrusters or propulsion systems. Isolator 100 includes an outer shield 102, an inner shield 104, an isolator housing assembly 106, and a stack or series of 13 ceramic isolator rings 108, each followed by a steel mesh screen 110. An arrow 112 shows the direction of gas flow through isolator 100. Current isolator designs, such as shown in FIG. 1, allow xenon to flow in a straight path through the segments. As a result, the xenon "sees" a path length that is roughly the length of the isolator.

However, as xenon ion thruster technology moves toward higher powers and accelerating voltages, the need for greater electrical isolation between system components increases. Next generation thrusters will require much higher voltage standoff, which may necessitate three to five times the number of segments of current designs. Consequently, isolators of current designs meeting the higher voltage standoff requirements would be larger, heavier, and more complex to assemble than present day isolators, such as shown in FIG. 1.

Accordingly, there is a need for a propellant isolator that is capable of higher electrical isolation without greatly increasing the size of the isolator.

SUMMARY

According to one aspect of the present invention, an propellant isolator includes segments that divert the flow of ions or gas in a non-linear path through the isolator. Extending the actual path length within the isolator without increasing the size of the isolator allows increased electrical standoff capability between ion thruster components without increasing the size of the thruster.

In one embodiment, the isolator includes a plurality of first isolator rings, a plurality of second isolator rings, and mesh screens adjacent to each of the first and second isolator rings, where the first and second isolator rings are each located alternately along the path of the gas flow. The first isolator rings, in this embodiment, are made of ceramic and are circular with a hole in the center through which the gas passes. The second isolator rings, in this embodiment, are also made of ceramic and circular, except that there is no center hole but there are four curved openings equally spaced along the circular portion. The gas flows through the curved openings. A mesh screen is located between each first isolator ring and second isolator ring, where the second isolator ring is "downstream" from the first isolator ring. Gas enters the isolator through a first isolator ring, passes through a second isolator ring, and flows through alternating first and second isolator rings until it exits the isolator through a final first isolator ring. Thus, with this embodiment, there are N first isolator rings and N−1 second isolator rings.

Gas passes through the center hole of the first isolator ring, through the mesh screen, where it is then forced outward along the surface of the second isolator ring until the gas passes out through the four outer openings of the second ring. The gas travels laterally along the four outer openings until it reaches the next first isolator ring. At that point, the gas is forced inward along the surface of the first isolator ring and through the center opening. The gas travels along this tortuous path until reaching the last first isolator ring, where it then passes out of the isolator and to the next component.

Thus, instead of having the gas (e.g., xenon) flow through segments along a fairly straight path, the present invention incorporates a unique set of offset segments (the second isolator rings) to provide a tortuous path for the xenon to flow, resulting in a longer effective path length, and thus higher standoff capability without increasing the length of the isolator. At these higher voltage isolation requirements for the next generation thrusters, the size and weight savings will be significant.

This invention will be more fully understood in conjunction with the following detailed description taken together with the following drawings.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION OF THE PREFERRED EMBODIMENTS

According to one aspect of the present invention, a propellant isolator includes two different types of isolator rings, with the first and second types alternating along the gas flow path. The two different types are such that gas flows through the center of the first isolator ring and is then diverted outward by the second isolator ring to flow through outer portions of the second isolator. The gas is subsequently diverted by the next first isolator ring through the center of the ring. The gas flows in this manner until it exits the isolator. This tortuous path, which increases the effective path length of the gas, allows a larger voltage standoff capability without increasing the length of the isolator ring.

Figure 2:
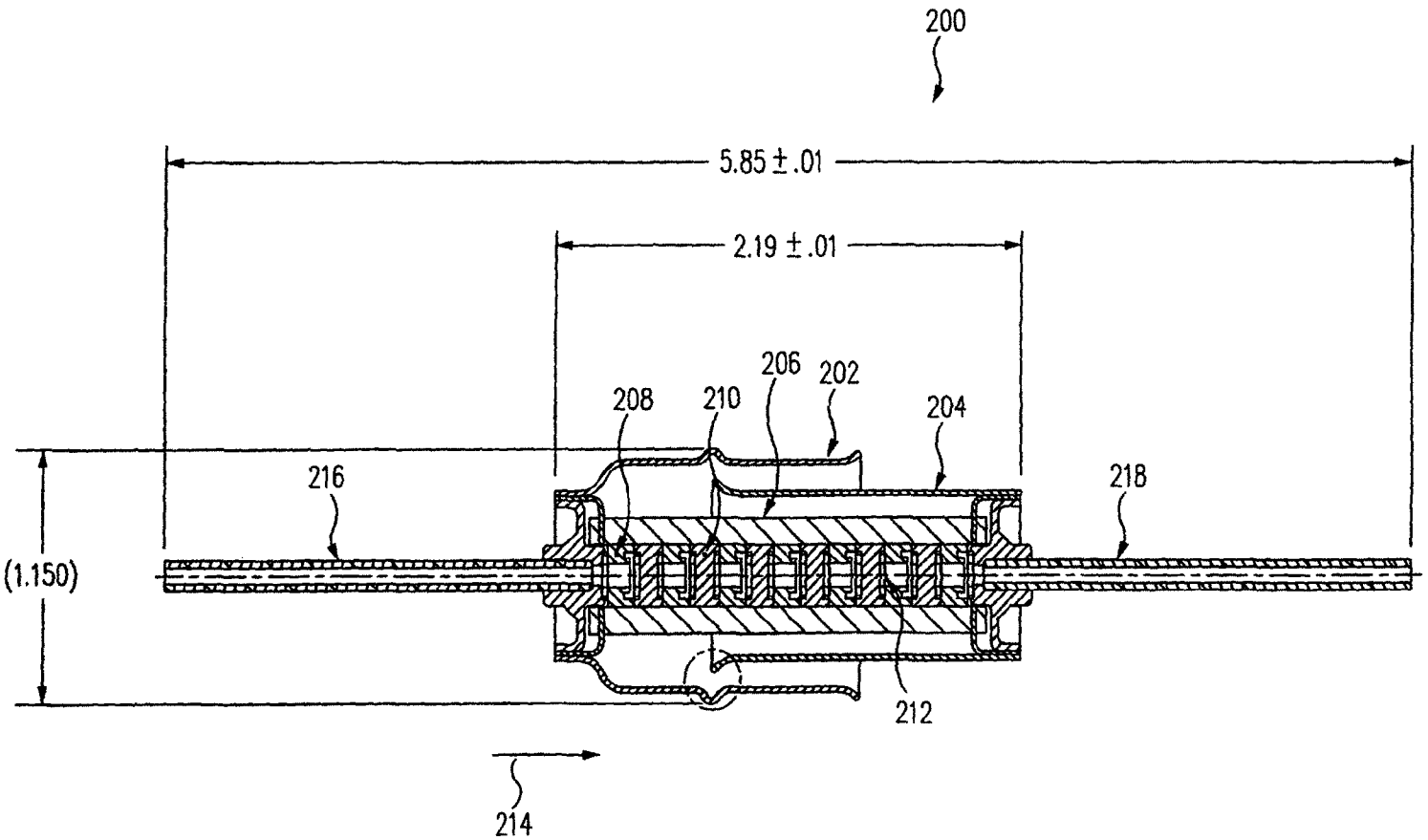
FIG. 2 is a diagram of a propellant isolator according to one embodiment of the invention.

FIG. 2 shows a propellant isolator 200 according to one embodiment of the invention. Isolator 200 includes an outer shield 202, an inner shield 204, an isolator housing assembly 206, N isolator rings $\mathbf{208}_1$ to $\mathbf{208}_N$ of a first type, N−1 isolator rings $\mathbf{210}_1$ to $\mathbf{210}_{N-1}$ of a second type, and 2N mesh screens $\mathbf{212}_1$ to $\mathbf{212}_{2N}$. Shields 202 and 204 and housing assembly 206 can be manufactured using the same materials as conventional shields and assemblies and for process compatibility, such as with the type of welding used. As shown in FIG. 2, N=7, although N can be any number, with larger N corresponding to longer isolators with higher voltage standoff capability. In one embodiment, isolator rings 208 and 210 are ceramic and mesh screens 212 are stainless steel, although other materials may also be suitable. Arrow 214 shows the direction of gas flow through isolator 200. A input feedline assembly or conduit 216 directs the xenon gas or other gas from a gas source (not shown) through isolator 200. An output feedline assembly or conduit 218 couples the gas exiting isolator 200 to an ion accelerator (not shown) or other component. In one embodiment, conduit 216 is at a low potential, such as ground, while conduit 218 is at a high potential, such as 1000 volts.

Figure 1:
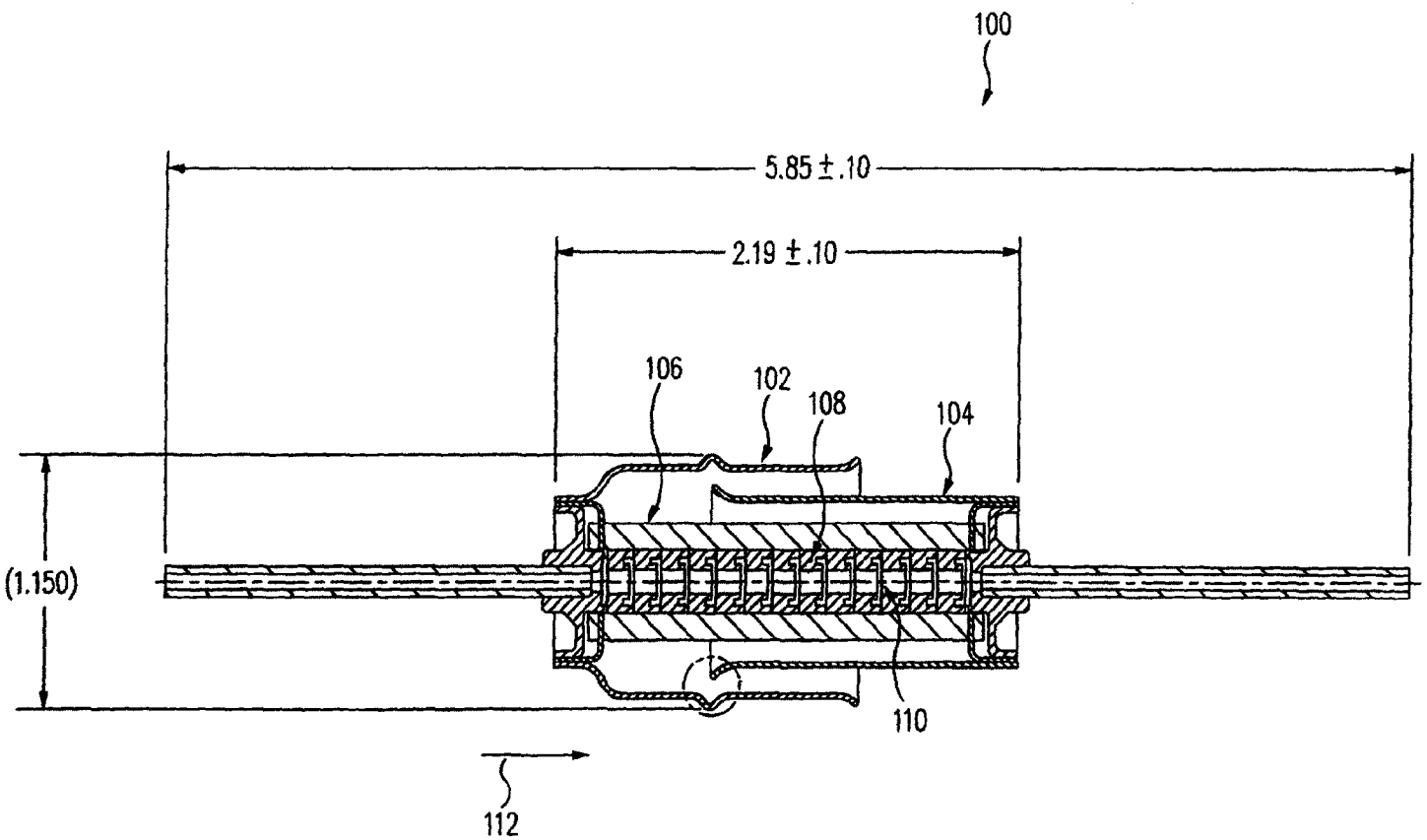
FIG. 1 is a diagram of a conventional propellant isolator.

Isolator 200 includes mesh screens 212 at the input of isolator 200 between input conduit 216 and isolator ring $\mathbf{208}_1$ and at the output of isolator 200 between output conduit 218 and isolator ring $\mathbf{208}_N$. Within housing assembly 206, isolator rings 208 and 210 are arranged alternately, with a mesh screen 212 between each two adjacent isolator rings. The two types of isolator rings 208 and 210 are designed such that they direct the gas first through a center portion of ring 208, along an outer portion of ring 210, and back through a center portion of a next one of ring 208. This continues until the gas flow exists through isolator ring $\mathbf{208}_N$. This increases the effective path that gas travels through the isolator, as compared with conventional isolators of FIG. 1, in which the gas travels a substantially straight path. Note that isolator rings 208 and 210 (or additional third, fourth, or more types) can be manufactured in any suitable design that directs the gas flow through isolator 200 in a tortuous path to achieve advantages of the present invention.

Figure 3B:
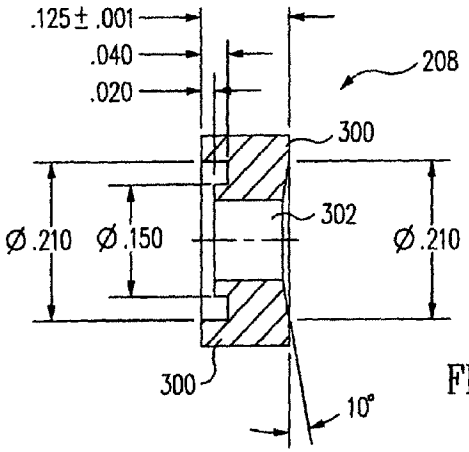
FIGS. 3A and 3B are front and side views, respectively, of a first type of isolator ring for use in the isolator of FIG. 2, according to one embodiment.
Figure 3A:
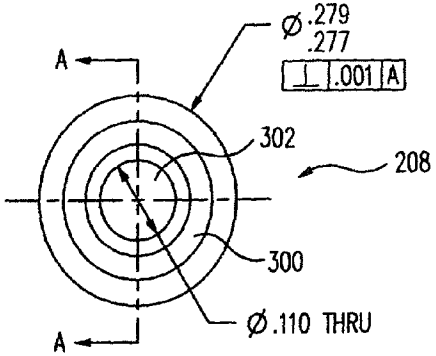

FIGS. 3A and 3B show front and side views, respectively, of isolator ring 208 according to one embodiment. FIG. 3B is a sectional view along line A-A of FIG. 3A. Isolator ring 208 has a solid portion 300 and a through-hole 302 in the center. In one embodiment, isolator ring has a length of approximately 0.125 inches and a diameter of approximately 0.278 inches, with through-hole 302 having a diameter of approximately 0.110 inches. Thus, isolator ring 208 has a cylindrical outer shape.

Figure 4B:
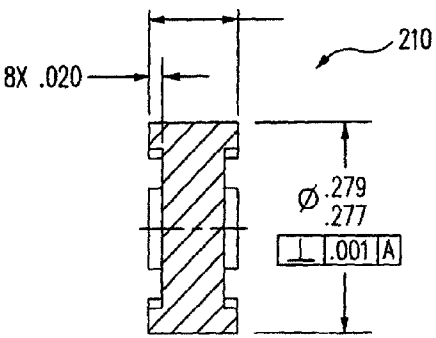
FIGS. 4A and 4B are front and side views, respectively, of a second type of isolator ring for use in the isolator of FIG. 2, according to one embodiment.
Figure 4A:
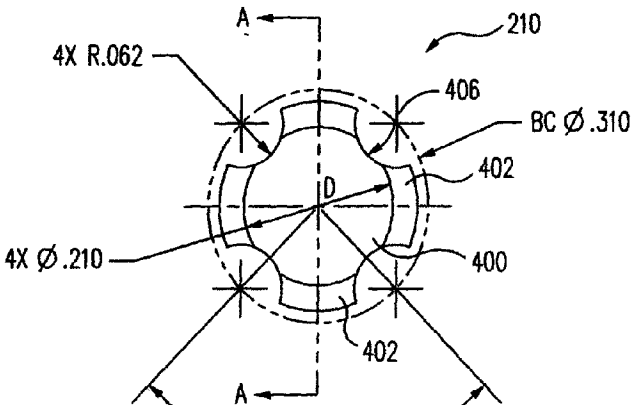

FIGS. 4A and 4B show front and side views, respectively, of isolator ring 210 according to one embodiment. FIG. 4B is a sectional view along line A-A of FIG. 4A. Isolator ring 210 has a solid inner portion 400 and extensions 402 extending from two or more areas of inner portion 400. In this embodiment, there are four extensions 402, although other numbers, such as two, three, five, etc. may also be used. The outer surface of extensions 402 is curved, such that extending the curve around isolator 210 forms a circular shape, with a diameter the same as that of isolator ring 208. In one embodiment, the diameter is approximately 0.278 inches, with inner portion 400 having an approximate diameter D of 0.210 inches, as shown in FIG. 4A, and a length of approximately 0.125 inches. Other diameters and lengths may also be suitable and can be variable to satisfy specific voltage standoff and size requirements. Note also that FIG. 4A shows inner portions 406 that are curved, but other shapes may also be suitable, such as linear or multi-sided (e.g., a groove).

With the embodiment of FIGS. 2-4, gas first flows through isolator ring $\mathbf{208}_1$ along through-hole 302. As it passes out of through-hole 302, it encounters solid inner portion 402 of isolator ring $\mathbf{210}_1$. Consequently, the gas is forced outward along the surface of solid inner portion 402. Once the gas reaches curved portion 406, the gas flows along the four passages created by inner portion 406 and the inner surface of isolator housing assembly 206. Once the gas travels to the end of the passages, it hits solid portion 300 of the next isolator ring $\mathbf{208}_2$. This solid portion, along with the inner surface of housing assembly 206, directs the gas inward toward through-hole 302 of isolator ring $\mathbf{208}_2$. The gas then travels through through-hole 302 of isolator ring $\mathbf{208}_2$ until it reaches the next isolator ring $\mathbf{210}_2$. This continues until the gas reaches the last isolator ring $\mathbf{208}_N$, at which time, the gas flows through through-hole 302 of isolator ring $\mathbf{208}_N$ and into output conduit 218. Consequently, the gas is directed inwardly and outwardly as it flows through isolator 200, resulting in a tortuous path.

Thus, instead of having the gas flow through one segment to another along a fairly straight path through the isolator, the present invention interrupts the flow from one segment going to another. This staggered lateral flow increases the flow length and adds a tortuous directional flow path which increases the electrical isolation capability from current designs, since the effective path length for the gas (e.g., xenon) is proportional to the voltage standoff capability of the isolator.

The above-described embodiments of the present invention are merely meant to be illustrative and not limiting. It will thus be obvious to those skilled in the art that various changes and modifications may be made without departing from this invention in its broader aspects. For example, the isolator rings (or segments) can be many different shapes, such that the gas flow through the isolator is tortuous instead of linear to provide advantages of the present invention. Although the above description discloses two or more passages associated with the second segment or isolator ring, the second isolator ring can be designed such that the gas is diverted through a single passage (such as a single off-center through-hole), but offset from the through-hole of the first isolator rings. Therefore, the appended claims encompass all such changes and modifications as fall within the true spirit and scope of this invention.

What is claimed is:

1. A high voltage propellant isolator, comprising:

a first set of isolator rings, each having at least a first opening;

a second set of isolator rings, each having at least a second opening offset from the first opening in a direction of gas flow through the isolator, wherein the gas flows through the high voltage propellant isolator in a tortuous path to increase an effective path length of the gas flow to increase an electrical standoff capability of the high voltage propellant isolator; and a housing with an inner cylindrical surface, wherein the first and second set of isolator rings are within inner cylindrical surface.

2. The isolator of claim 1, wherein the first opening is circular and located at the approximate center of the first set of isolator rings.

3. The isolator of claim 2, wherein the second opening is located along an outer periphery of the second set of isolator rings.

4. The isolator of claim 3, wherein the second opening comprises at least two passages.

5. The isolator of claim 3, wherein the outermost portion of the second set of isolator rings contacts the inner surface of the housing.

6. The isolator of claim 1, wherein the first and second openings are non-overlapping.

7. The isolator of claim 1, wherein the first and second set of isolator rings comprise a ceramic.

8. The isolator of claim 1, wherein the first and second set of isolator rings are located alternately along the length of the isolator.

9. The isolator of claim 1, further comprising a mesh screen located behind each of the first and second set of isolator rings.

10. The isolator of claim 1, wherein the gas is xenon.

* * * * *

UNITED STATES PATENT AND TRADEMARK OFFICE

CERTIFICATE OF CORRECTION

PATENT NO. : 8,136,340 B2
APPLICATION NO. : 12/851382
DATED : March 20, 2012
INVENTOR(S) : Stephen L. Hart It is certified that error appears in the above-identified patent and that said Letters Patent is hereby corrected as shown below:

On title page:

Item 73 Replace -- Torrance, GA -- with -- Torrance, CA --

Signed and Sealed this
First Day of May, 2012

David J. Kappos

David J. Kappos
*Director of the United States Patent and Trademark Office*